United States Patent [19]

Frazier

[11] 4,455,250

[45] Jun. 19, 1984

[54] STABLE LIQUID HARD SURFACE CLEANSER COMPOSITION CONTAINING DGH AND A QUATERNARY GERMICIDE

[75] Inventor: Charles Frazier, Kinnelon, N.J.

[73] Assignee: American Cyanamid Company, Stamford, Conn.

[21] Appl. No.: 372,770

[22] Filed: Apr. 28, 1982

Related U.S. Application Data

[63] Continuation-in-part of Ser. No. 224,605, Jan. 12, 1981, abandoned.

[51] Int. Cl.[3] ..... C11D 1/835; C11D 3/48

[52] U.S. Cl. ..... 252/106; 252/DIG. 14

[58] Field of Search ..... 252/106; 424/326, 329

[56] References Cited

U.S. PATENT DOCUMENTS

| | | | |
|---|---|---|---|
| Re. 29,649 | 5/1978 | Farnsworth | 252/171 |
| 2,213,474 | 9/1940 | Puetzer | 424/326 X |
| 3,023,144 | 2/1962 | Greathouse | 252/106 |
| 3,436,461 | 4/1969 | Scotti | 424/326 X |
| 3,539,520 | 11/1970 | Cantor | 252/106 |
| 3,694,365 | 9/1972 | Castner | 252/106 |
| 3,733,277 | 5/1973 | Wooden | 252/106 |
| 3,965,026 | 6/1976 | Lancz | 252/106 |

*Primary Examiner*—Dennis L. Albrecht

*Attorney, Agent, or Firm*—William H. Calnan

[57] ABSTRACT

Efficacious disinfectant/cleansing compositions for hard surface soil and stain removal, more particularly germicidally effective hard surface cleansers, optionally containing d-limonene.

10 Claims, No Drawings

STABLE LIQUID HARD SURFACE CLEANSER COMPOSITION CONTAINING DGH AND A QUATERNARY GERMICIDE

This application is a continuation-in-part of copending application Ser. No. 224,605, filed Jan. 12, 1981, now abandoned.

The present invention relates to efficacious disdisinfectant/cleansing compositions for hard surface soil and stain removal. More particularly, it relates to germicidally effective hard surface cleansers, optionally containing d-limonene.

The aqueous, stable compositions of the invention comprise a quaternary ammonium compound, n-dodecylguanidinium hydrochloride, a specific nonionic surfactant, a lower aliphatic alcohol, and water. Optionally, and preferably, the compositions further contain d-limonene and a specific alkali detergent builder.

Cleansing compositions containing quaternary ammonium compounds are known. Quaternary ammonium compounds which exhibit germicidal effectiveness against both gram-positive and gram-negative bacteria are strong eye irritants, however, as determined by the well-known Draize Test. Therefore, compositions containing them in a germicidally effective amount constitute a risk of eye irritation caused by accidental spillage or splashing.

n-Dodecylguanidinium hydrochloride is also a known bactericidal and antifungal agent. However, when the n-dodecylguanidinium hydrochloride is used alone in the compositions of the present invention, as a replacement for the quaternary ammonium compounds, the compositions are not physically stable. And at higher pH, i.e., above about 9.5, the n-dodecylguanidinium hydrochloride itself may become chemically unstable and decompose, thereby being rendered germicidally less effective.

The present invention is based on the discovery that compositions which have incorporated therein a combination of a germicidally effective quaternary ammonium compound and n-dodecylguanidinium hydrochloride, in a weight ratio of the former to the latter of at least about 1/1 exhibit good product stability, efficacious germicidal activity and reduced eye irritancy and all of these characteristics are maintained even under highly alkaline conditions, i.e., at pHs above about 9.5.

Thus, in accordance with the present invention, a combination of n-dodecylguanidinium hydrochloride (DGH) and either (a) a dialkyldimethyl ammonium chloride, (b) an n-alkyldimethylbenzyl ammonium chloride or (c) n-alkyldimethylethylbenzyl ammonium chloride, or a mixture thereof, is incorporated into the cleansing compositions at a concentration of from about 2.5 to 4 percent by weight, using a ratio of quaternary ammonium compound of n-dodecylguanidinium hydrochloride (Quat/DGH) of at least about 1/1, preferably from at least about 1/1 to about 3/1. Preferred compositions of the invention will contain about 2.5 to 3 percent, by weight, of total germicidal agent at a Quat/DGH ratio of about 1/1, and will contain, as the quaternary ammonium compound, a long chain ($C_8$–$C_{12}$) dialkyldimethyl ammonium chloride. A particularly preferred quaternary is a mixture of about 25% dioctyl-, 25% didecyl-; and about 50% octyldecyldimethyl ammonium chloride (Bardac 20, Lonza Chemical Co.).

In addition to the germicidal combination described, the compositions will contain a non-ionic surfactant having an HLB (Hydrophile-Lipophile Balance) in the range of about 12.5 to 14. Suitable such non-ionic surfactants include NEODOL TM 25-9 (Shell Chemical Co.), a linear ($C_{12}$–$C_{15}$) primary alcohol ethoxylate containing about 9 moles of condensed ethylene oxide; IGEPAL TM CA-630, CA-720 and CA-730, octylphenoxypoly (ethyleneoxy) ethanols, and IGEPAL TM CO-630 and CO-710, nonylphenoxypoly(ethyleneoxy) ethanols, made by GAF Corporation; TERGITOL TM 15-S-7 and 15-S-9, polyethylene glycol ethers of linear alcohols, made by Union Carbide Corporation; and POLYTERGENT TM B-300 and B-350, nonylphenoxy polyethoxyethanols, made by Olin Corporation. The non-ionic surfactant is used in an amount of from about 1 to 10 percent, by weight, preferably about 3 to 8 percent, by weight. The ratio of nonionic to quaternary is preferably about 2/1 to about 4/1.

d-Limonene is optionally incorporated as both a fragrance and as a soil-removing and grease-cutting solvent in an amount of about 0 to 4 percent, by weight, preferably about 2 to 3.5 percent, by weight. Compositions in accordance with the present invention preferably will contain d-limonene.

Although alkali detergent builders are also preferably incorporated into the formulations of the present invention, carbonates, phosphates, and metasilicates have been found to promote product instability by forming insoluble substances at or below room temperature and should not be used. Builders which may be used include the sodium and potassium salts of ethylenediamine tetraacetic acid; sodium and potassium citrates; and sodium and potassium gluconates. Sodium is the preferred cation for reasons of cost. When used, the alkali builder is generally present in an amount of about 2 to 10 percent, by weight, preferably about 2 to 5 percent by weight.

A lower aliphatic alcohol, such as ethanol, is used to provide a clear, stable, aqueous alcoholic solution. Ordinarily, about 1 to 6 percent by weight is added, preferably about 2 to 4 percent.

The remainder of the composition is water, although a dye or UV-absorber compound, or the like, may be added in small amount if desired.

The compositions of the present invention pass the AOAC Use Dilution Test for disinfectant compositions at a rate which gives statistical confidence, that is, they pass the test with a 95% confidence level.

EXAMPLES 1–9

Compositions were prepared containing from 2.5 to 3.5 percent total germicide at ratios of quaternary ammonium compound to n-dodecylguanidinium hydrochloride (Quat/DGH) of 1/1 to 3/1. The compositions additionally contained 7% Neodol 25-9, 3% d-limonene, 3% ethanol (95%), 2% $Na_4EDTA$ and water to a total of 100%. The following Table I shows the preformance of the various formulations.

TABLE I

Composition, Stability and Performance of Quat/DGH Formulations

| | Example | | | | | | | | |
|---|---|---|---|---|---|---|---|---|---|
| | 1 | 2 | 3 | 4 | 5 | 6 | 7 | 8 | 9 |
| Total Germicide, % | 3.5 | 3.0 | 2.5 | 3.5 | 3.0 | 2.5 | 3.5 | 3.0 | 2.5 |
| Bardac 20/DGH | 3/1 | 3/1 | 3/1 | 2/1 | 2/1 | 2/1 | 1/1 | 1/1 | 1/1 |
| Water | | | | | q.s. to 100 | | | | |
| pH | 11.4 | | | 11.1 | | | 10.7 | | |
| Stability, Physical | | | | | | | | | |
| Chill, weeks (5° C.) | 12 | | | | | | 7 | 12 | 12 |
| RT, weeks | | | | | | 12 | | | |
| 50° C., weeks | | | | | | 12 | | | |
| Microbiological Testing vs. *S. Aureus* | | | | | | | | | |
| AOAC @ 1:64[1] | 10−/10 | | | 10−/10 | | | 10−/10 | | |
| QHST[2] Initial CFU/ml × $10^{-3}$ | 2.1 | 0.083 | 0.0 | 0.027 | 1.9 | 1.5 | 0.027 | 0.083 | 0.22 |
| QHST[3] Initial CFU/ml × $10^{-3}$ | 2.6 | | | 2.5 | | | 0.01 | | |
| Eye Irritation[4] | | | | | | | | | |
| Mean Ocular Score, Initial | 78 | | | 71 | | | 63 | | 78 |
| Mean Ocular Score, 21 Days | 12 | | | 6 | | | 20 | | 59 |

[1]AOAC Use Dilution Test; diluted 1:64
[2]Quantitative Hard Surface Test (QHST); Colony forming units per ml × $10^{-3}$ (CFU); Control was 2700 × $10^3$.
[3]See [2]; Control was 369 × $10^3$ CFU.
[4]Draize Test, 21 Days, 3 rabbits, 0.1 ml dose The data illustrate that the compositions readily pass the AOAC Use Dilution Test ("Disinfectants-Use Dilution Method," AOAC Official Action, p. 61, 11th Ed., 1970) and are effective against S. aureus, as determined by the Quantitative Hard Surface Test. The Quantitative Hard Surface Test is a modified version of the AOAC Use Dilution Test, wherein the medication tubes are vibrated to dislodge the bacteria following treatment, and wherein the survivors are counted to assess the efficacy of the cleanser in quantitative terms rather than the qualitative pass/fail used in the Use Dilution Test. A three-log reduction in Colony forming units is considered to be effective germicidal activity. Data also indicate that eye irritation is significantly reduced.

When the above compositions are tested for efficacy without the presence of d-limonene, similar results are obtained.

EXAMPLES 10–16

Compositions are prepared containing from 2.5 to 3.5 percent total germicide at ratios of quaternary ammonium compound (Bardac 20) to n-dodecylguanidinium hydrochloride (Quat/DGH) as shown. The compositions also contained 7% Neodol 25-9, 3% d-limonene, 3% ethanol (95%), 2% tetrasodium ethylenediamine tetraacetate ($Na_4EDTA$) and water to 100%. The following Table II shows the stability of the various formulations at chill temperatures (about 5° C.)

TABLE II

| Example | 10 | 11 | 12 | 13C | 14C | 15C | 16C |
|---|---|---|---|---|---|---|---|
| Total Germicide, % | 3.5 | 3.5 | 3.5 | 3.5 | 3.5 | 3 | 2.5 |
| Ratio, Bardac 20/DGH | 3/1 | 2/1 | 1/1 | 1/2.5 | 1/3 | 1/3 | 1/3 |
| pH | 11.39 | 11.14 | 10.7 | 10.34 | 10.29 | — | — |
| Stability (in days) | 84 | 84 | 50 | 4 | 4 | 8 | 48 |
| Appearance on day given* | clear | clear | cloudy | ppt** | ppt** | ppt** | ppt** |

C = Comparative example
* = Stability test conducted for 84 days
** = precipitation As is seen from Table II, compositions 13–16, wherein the ratio of Bardac 20/DGH is not within the range of the compositions of the present invention, possess generally much poorer stability than that of compositions 10–12.

EXAMPLES 17 AND 18

Compositions were prepared having only n-dodecylguanidinium hydrochloride (DGH) as the germicide and having the following ingredients, in weight percent:

| | Example 17 | Example 18 |
|---|---|---|
| DGH | 3.5 | 3.5 |
| Ethanol (95%) | 4 | 18 |
| d-limonene | 3 | 3 |
| NEODOL 25-9 | 7 | 7 |
| $Na_4EDTA$ | 2 | 2 |
| $H_2O$ | qs to 100 | qs to 100 |
| pH | 10.1 | — |

Each formulation remained stable at about 5° C. for only one (1) day, at which time precipitation was observed. It is seen, therefore, that the presence of the n-dodecylguanidinium hydrochloride alone in the compositions renders them quite unstable compared to those compositions wherein the ratio of quaternary ammonium compound/DGH is at least about 1/1. it is noted that even the addition of considerably more ethanol (Example 18), the function of which is to enhance stability, did not result in the stabilization of the composition.

The following Examples further illustrate the importance of using the particular alkali builders hereinabove described, as well as the criticality of the quaternary ammonium compound/n-dodecylguanidinium hydrochloride ratio.

EXAMPLES 19–39

Compositions were prepared containing 3.5% total germicide, 3% ethanol (95%), 3% d-limonene, 7% NEODOL 25-9 and water to 100%. The quaternary ammonium compound (Bardac 20)/n-dodecylguanidinium hydrochloride (DGH) ratio, the alkali builder used and the percentage thereof present, and the stability for each composition is provided in Table III below. The pH for most of the compositions is also given.

TABLE III

| EXAMPLE | BARDAC 20/DGH | ALKALI BUILDER (Amt. Added) | pH | STABILITY* |
|---|---|---|---|---|
| 19 | 3/1 | $C_6H_5Na_3O_7.2H_2O$(3.5%) | 7.5 | >96 days |
| 20 | 1/1 | " | — | 74 days |
| 21 | 2/1 | " | — | >94 days |
| 22C | 1/3 | " | 7.2 | 4 days |
| 23 | 3/1 | " | 7 3 | >87 days |
| 24 | 2/1 | " | — | >87 days |
| 25 | 1/1 | " | — | 87 days |
| 26C | 1/2 | " | — | 3 days |
| 27C | 1/3 | " | 7.2 | 3 days |
| 28 | 3/1 | $C_6H_{11}NaO_7$ (3.5%) | 6.5 | 56 days |
| 29 | 2/1 | " | 6.5 | 63 days** |
| 30 | 1/1 | " | 6.2 | 63 days** |
| 31 | 3/1 | " | 6.2 | 63 days** |
| 32 | 2/1 | " | 6.2 | 63 days** |
| 33 | 1/1 | " | 6.2 | 63 days** |
| 34C | 1/1 | $Na_2SiO_3$ (0.5%) | 12.2 | 1 day |
| 35C | 2/1 | " | 12.3 | 5 days |
| 36C | 3/1 | " | 12.4 | >75 days, but failed in 75 days at 50° C. |
| 37C | 2/1 | $Na_3PO_4$ (1.0%) | — | <1 day |
| 38C | 3/1 | " | 11.6 | <1 day |
| 39C | 1/1 | " | 11.8 | <1 day |

*At about 5° C., unless otherwise noted.
**Heavy oiling developed at end of time period. Upon shaking, formulation restabilized.
C = Comparative Example As is seen from Table III, when the builder added is a citrate or gluconate, the compositions are quite stable provided the ratio of BARDAC 20/DGH is at least about 1/1 (Examples 19–21, 23–25, 28–33). However, when the ratio of BARDAC 20/DGH is less than about 1/1, the compositions are relatively significantly less stable (Examples 22, 26 and 27). Also when the builder is a metasilicate (Examples 34–36) or a phosphate (Examples 37–39), the compositions do not possess satisfactory stability reardless of the ratio of BARDAC 20/DGH.

What is claimed is:

1. A germicidally effective, stable aqueous alcoholic hard surface cleaner composition comprising from about 1 to 10 percent, by weight, of a nonionic surfactant having a Hydrophile-Lipophile Balance in the range of about 12.5 to 14, from about 2.5 to 4 percent, by weight, of a germicide consisting of (a) n-dodecylguanidinium hydrochloride and (b) one or more dialkyldimethyl ammonium chlorides, wherein the alkyl groups are independently about $C_8$ to $C_{12}$, the ratio of (b) to (a) being at least about 1:1 to about 3:1.

2. A composition in accordance with claim 1 which additionally comprises about 2 to 10 percent, by weight, of an alkali detergent builder selected from sodium citrate, potassium citrate, sodium gluconate, potassium gluconate, and the sodium and potassium salts of ethylenediamine tetraacetic acid.

3. A composition in accordance with claim 2 wherein the alkali detergent builder comprises about 2 to 5 percent, by weight, of the composition and is selected from sodium citrate, tetrasodium ethylenediamine tetraacetate, and sodium gluconate.

4. A composition in accordance with claim 1 wherein said non-ionic surfactant is a long-chain ($C_{12}$–$C_{15}$) linear primary alcohol ethoxylate having about 9 moles of condensed ethylene oxide.

5. A composition in accordance with claim 1 wherein said quaternary ammonium compound is a mixture of dioctyl-, didecyl- and octyldecyldimethyl ammonium chlorides.

6. A composition in accordance with claim 1, 2, 3, 4, or 5 which additionally comprises d-limonene.

7. A composition in accordance with claim 6 wherein the d-limonene comprises up to about 4 percent, by weight, thereof.

8. A composition in accordance with claim 6 wherein the d-limonene comprises about 2 to 3.5 percent, by weight, thereof.

9. A composition in accordance with claim 1 wherein the pH is above about 9.5.

10. A composition in accordance with claim 9 which is free of metasilicate and phosphate anions.

* * * * *